US009252526B2

(12) United States Patent
Cho et al.

(10) Patent No.: US 9,252,526 B2
(45) Date of Patent: Feb. 2, 2016

(54) WATERPROOF CONNECTOR FOR VEHICLE

(71) Applicants: HYUNDAI MOTOR COMPANY, Seoul (KR); KUM CO., LTD., Ulsan (KR); THN CO., LTD., Daegu (KR)

(72) Inventors: Ha Young Cho, Suwon-si (KR); Young Jong Lee, Seoul (KR); Jeong Wook Choi, Ulsan (KR); Nam Jin Kang, Ulsan (KR); Jae Hyoung Kim, Busan (KR); Tae Hong Yun, Suwon-Si (KR)

(73) Assignees: HYUNDAI MOTOR COMPANY, Seoul (KR); KUM CO., LTD., Ulsan (KR); THN CO., LTD., Daegu (KR)

( * ) Notice: Subject to any disclaimer, the term of this patent is extended or adjusted under 35 U.S.C. 154(b) by 0 days.

(21) Appl. No.: 14/542,287

(22) Filed: Nov. 14, 2014

(65) Prior Publication Data

US 2015/0236442 A1 Aug. 20, 2015

(30) Foreign Application Priority Data

Feb. 18, 2014 (KR) ..... 10-2014-0018569

(51) Int. Cl.
*H01R 13/52* (2006.01)
*H01R 4/02* (2006.01)

(52) U.S. Cl.
CPC ..... *H01R 13/5221* (2013.01); *H01R 4/023* (2013.01); *H01R 13/5216* (2013.01)

(58) Field of Classification Search
CPC ..... H01R 13/5221; H01R 13/5216
See application file for complete search history.

(56) References Cited

U.S. PATENT DOCUMENTS 4,998,894 A * 3/1991 Gronvall ..... G02B 6/4447 439/133
6,102,739 A * 8/2000 Murakami ..... F16H 61/0006 439/587
6,302,734 B1 * 10/2001 Ichio ..... H01R 13/5208 439/274
6,364,692 B1 * 4/2002 Okayasu ..... H01R 13/5219 439/204

(Continued)

FOREIGN PATENT DOCUMENTS

JP 2005-123102 A 5/2005
JP 2009-241673 A 10/2009

(Continued)

OTHER PUBLICATIONS

Korean Patent Publication No. 2011-0120745 (Nov. 4, 2011).*

(Continued)

*Primary Examiner* — James Harvey
(74) *Attorney, Agent, or Firm* — McDermott Will & Emery LLP

(57) ABSTRACT

A waterproof connector for a vehicle includes a front holder mounted on a front side of a main housing via a front seal for watertight, and having terminal-connecting holes. The front seal and the front holder are disposed inside the first mounting hole sequentially. An inner housing with a terminal is mounted to a rear side of the main housing and has terminal insertion holes. A subcover is disposed at a rear side of the inner housing. Each terminal has a connector portion disposed inside a terminal-connecting hole of the front holder, and a wire-welding portion is disposed inside a terminal insertion hole of the inner housing. Watertight and vibration-absorbing materials are attached to a lower side of an upper cover and an upper side of a lower cover of the subcover to protect the wire-welding portions of the terminals.

11 Claims, 8 Drawing Sheets

(56) References Cited

U.S. PATENT DOCUMENTS 6,443,765 B2 * 9/2002 Ichio ..... H01R 13/5219 439/274
6,443,766 B2 * 9/2002 Ichio ..... H01R 13/5219 439/274
7,594,821 B1 * 9/2009 Hasija ..... G06Q 40/04 439/271
2004/0121639 A1 * 6/2004 Yaworski ..... H01R 4/36 439/276
2006/0270271 A1 * 11/2006 Moriyama ..... H01R 9/032 439/499
2007/0264864 A1 * 11/2007 Andre ..... H01R 12/69 439/492
2011/0159731 A1 * 6/2011 Kataoka ..... B60R 16/0207 439/604
2012/0324726 A1 * 12/2012 Kataoka ..... H01R 13/5216 29/857
2015/0236442 A1 * 8/2015 Cho ..... H01R 4/023 439/271

FOREIGN PATENT DOCUMENTS

KR 1998-064677 A 10/1998
KR 20-0261791 B2 1/2002
KR 10-2002-0032228 A 5/2002
KR 10-2004-0106001 A 12/2004
KR 10-2005-0100140 A 10/2005

OTHER PUBLICATIONS (Korean Registered Utility Model No. 20-0429694 (Oct. 19, 2006)).*

* cited by examiner

WATERPROOF CONNECTOR FOR VEHICLE

CROSS-REFERENCE TO RELATED APPLICATION

This application claims under 35 U.S.C. §119(a) the benefit of priority to Korean Patent Application No. 10-2014-0018569 filed on Feb. 18, 2014, the entire contents of which are incorporated herein by reference.

BACKGROUND (a) Technical Field

The present disclosure relates to a waterproof connector for a vehicle, and more particularly, to a waterproof connector for a vehicle to improve waterproof and vibration resistant performance of a flexible flat cable (FFC) connector for connecting various electronic and electric devices.

(b) Background Art

In general, a connector for a vehicle is provided to connect various electronic and electric devices that are installed in the vehicle.

There are some risks involved with the connector, such as terminals being easily separated from their positions according to vibrations or travelling conditions of the vehicle, which results in a bad connection. Moisture may get in from surroundings which results in corrosion and a short.

The connector for a vehicle is manufactured with various structures such as a structure for maintaining the connections from vibrations and shocks of the vehicle, a structure for preventing water penetration, and the like.

For example, Korean Patent Publication No. 2011-0120745 (Nov. 4, 2011) discloses a waterproof connector including a waterproof seal mounted therein and a protector cover for protecting the waterproof seal.

There is another example of existing waterproof connector for a vehicle, such as a waterproof connector in which a waterproof seal is easily inserted into a housing (Korean Registered Utility Model No. 20-0429694 (Oct. 19, 2006)).

Such existing waterproof connectors for a vehicle have a simple structure provided with a waterproof seal to block water penetration. However, durability thereof becomes inferior for a long time use, and the waterproof performance of connected portions between components may be deteriorated.

SUMMARY OF THE DISCLOSURE

The present disclosure has been made in an effort to solve the above-described problems. An aspect of the present disclosure provides a waterproof connector for a vehicle including a front holder mounted on a front side of a main housing via a front seal for watertight. An inner housing has a terminal installed at a rear side of the main housing, and a subcover is installed at a rear side of the inner housing between rear seals for watertight, resulting in improved waterproof performance.

Another aspect of the present disclosure provides a waterproof connector for a vehicle for providing improved waterproof performance, protecting a portion connected to a flexible flat cable with a subcover, and providing watertight and vibration-absorbing material attached to the subcover for improved vibration resistance performance.

In accordance with an embodiment of the present disclosure, a waterproof connector for a vehicle includes a main housing having a first mounting hole, formed on a front side thereof, in which a front holder is disposed and a second mounting hole, formed on a rear side thereof, in which an inner housing and a subcover are disposed. A watertight front seal is disposed inside the first mounting hole before the front holder. A watertight rear seal is engaged with a peripheral of an inner side and disposed inside the second mounting hole of the main housing with the inner housing. A plurality of terminals, each of which has a connector portion that is disposed inside a terminal-connecting hole of the front holder. A wire-welding portion is disposed inside a terminal insertion hole of the inner housing, in which the connector portion and the wire-welding portion are integrally formed with each other. Watertight and vibration-absorbing materials are attached to a lower side of an upper cover and an upper side of a lower cover of the subcover to protect a plurality of wire-welding portions of the plurality of terminals. The front holder is disposed inside the first mounting hole of the main housing, closely attached to the front seal, and has the plurality of terminal connecting holes corresponding to the plurality of terminals. The inner housing, which is disposed inside the second mounting hole of the main housing, has the plurality of terminal insertion holes, corresponding to the plurality of terminals. A front press-fitting end is disposed inside the second mounting hole, and a rear seal seat, a thickness of which is thinner than that of the front press-fitting end. The subcover is disposed inside the second mounting hole of the main housing and includes the upper cover and the lower cover assembled with upper and lower sides of the rear seal seat of the inner housing to cover the wire-welding portions of the terminals.

The main housing may include a first overlap-preventing stopper and a second overlap-preventing stopper, which protrude from an inner surface of the second mounting hole of the main housing to prevent the inner housing and the subcover from overlapping, wherein the first and second overlap-preventing stoppers are spaced apart in a longitudinal direction.

The main housing has a subcover-locking hole formed on an inner wall of the second mounting hole of the main housing.

The front holder may have terminal locking protrusions integrally protruding from a bottom of each terminal connecting hole.

A step between the front press-fitting end of the inner housing and the rear seal seat may serve as a third overlap-preventing stopper for preventing the rear seal.

The rear seal seat has a plurality of subcover connecting holes formed at a rear side of the inner housing to penetrate the rear seal seat vertically.

The connector portion may have locking recesses, formed on a lower side of each of the plurality of terminals, with which terminal locking protrusions of the front holder are engaged.

On interfaces between the connector portions of the plurality of terminals and the wire-welding portions, fixing protrusions are press-fitted into the terminal insertion holes of the inner housing and protrude integrally.

The upper cover of the subcover may have subcover-mounting holes aligned with subcover connecting holes of the rear seal seat and penetrating the upper cover, and the lower cover has subcover assembling pins integrally formed on the upper side of the lower cover and sequentially disposed inside the subcover connecting holes and the subcover-mounting holes.

The upper cover and the lower cover of the subcover have subcover locking protrusions formed on sides thereof and disposed inside subcover-locking holes formed in an inner wall of the second mounting hole.

The watertight and vibration-absorbing materials may be made of butyl rubber.

As described above, the waterproof connector for a vehicle has the following advantages:

First, a front seal and a rear seal are disposed inside a first mounting hole and a second mounting hole of a main housing for watertight to improve waterproof performance of the waterproof connector for a vehicle according to the present disclosure;

Second, an inner housing for arranging a plurality of terminals is disposed inside the second mounting hole of the main housing, so that the terminals can be prevented from being bent and the arrangement of the terminals can be kept without any damage;

Third, a subcover covers the outside of the inner housing so that the welding portions of wires of the terminals exposed through the inner housing can be prevented from being damaged; and Fourth, a butyl rubber as a member for maintaining watertight and absorbing vibrations disposed inside between the inner housing and the subcover to prevent the welding portion of the wires of the terminals from being short, to improve the vibration resistance performance and to prevent water penetration into the welding portions of the wires of the terminals.

BRIEF DESCRIPTION OF THE DRAWINGS

The above and other features of the present disclosure will now be described in detail with reference to certain exemplary embodiments thereof illustrated the accompanying drawings which are given hereinbelow by way of illustration only, and thus are not limitative of the present disclosure.

Figure 1:
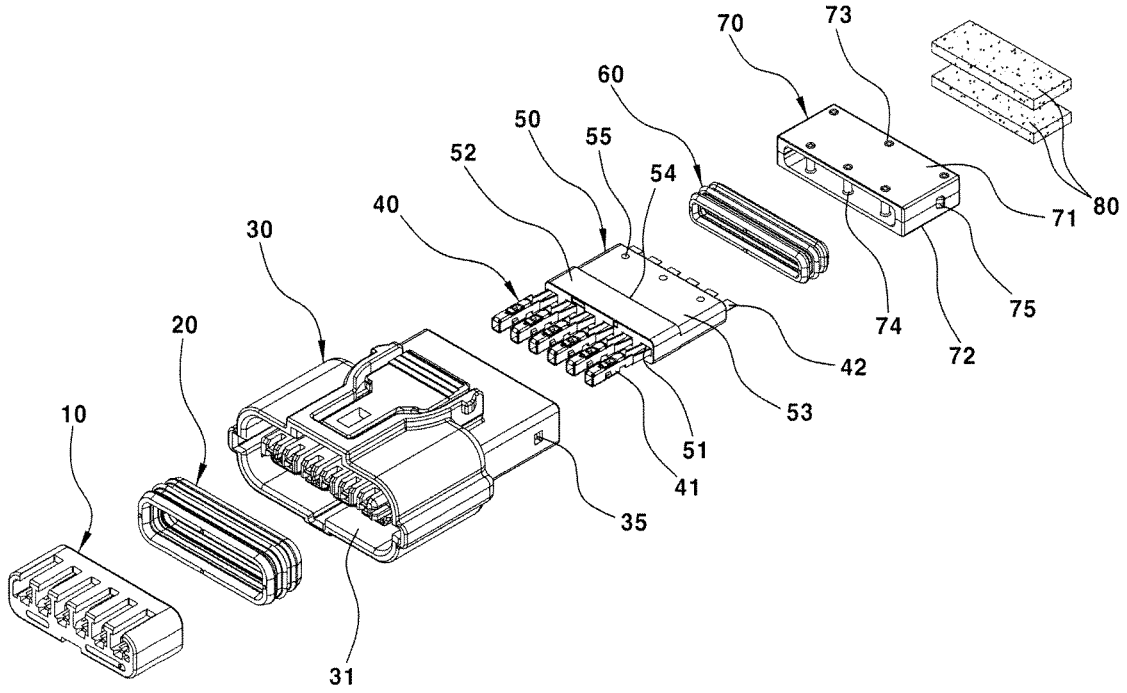
FIG. 1 is an exploded perspective view illustrating a waterproof connector for a vehicle according to an embodiment of the present disclosure.

It should be understood that the appended drawings are not necessarily to scale, presenting a somewhat simplified representation of various features illustrative of the basic principles of the invention. The specific design features of the present disclosure as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawing.

DETAILED DESCRIPTION

Hereinafter, the present disclosure will be described in detail so that those skilled in the art to which the present disclosure pertains can easily carry out the present disclosure.

Figure 8:
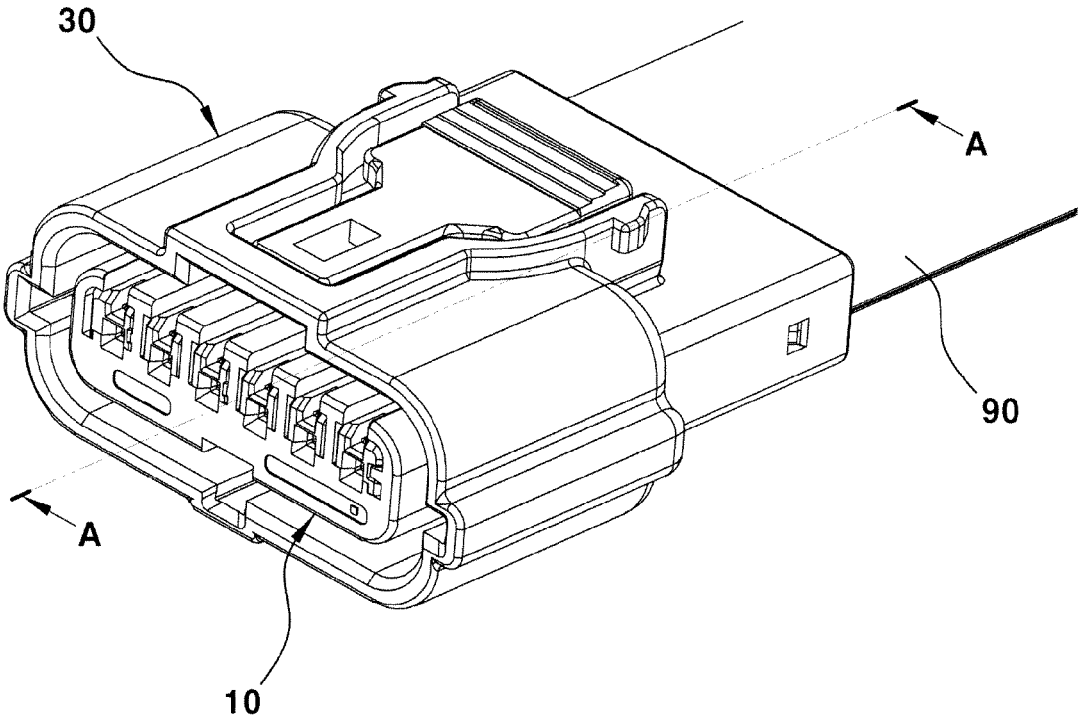
FIG. 8 is a perspective view illustrating an assembly of the waterproof connector for a vehicle according to an embodiment of the present disclosure.

FIG. 1 is an exploded perspective view illustrating a waterproof connector for a vehicle according to an embodiment of the present disclosure, and FIG. 8 is a perspective view illustrating an assembly of the waterproof connector for a vehicle according to an embodiment of the present disclosure.

As illustrated in FIGS. 1 and 8, a reference numeral '30' indicates a main housing serving as a frame of a waterproof connector for a vehicle according to an embodiment of the present disclosure.

A front seal 20 and a front holder 10 are sequentially mounted at a front side of the main housing 30. An inner housing 50, with which terminals 40 are connected, a rear seal 60, a subcover 70, and watertight and vibration-absorbing members 80 are sequentially mounted at a rear side of the main housing 30.

The main housing 30 has a first mounting hole 31, into which the front seal 20 and the front holder 10 are sequentially inserted, formed at the front side thereof and a second mounting hole 32, into which the inner housing 50 and the subcover 70 are inserted, formed at a rear side thereof. The first mounting hole 31 and the second mounting hole 32 communicate with each other, such that connector portions 41 as a front side of the terminals 40 pass through.

Figure 3:
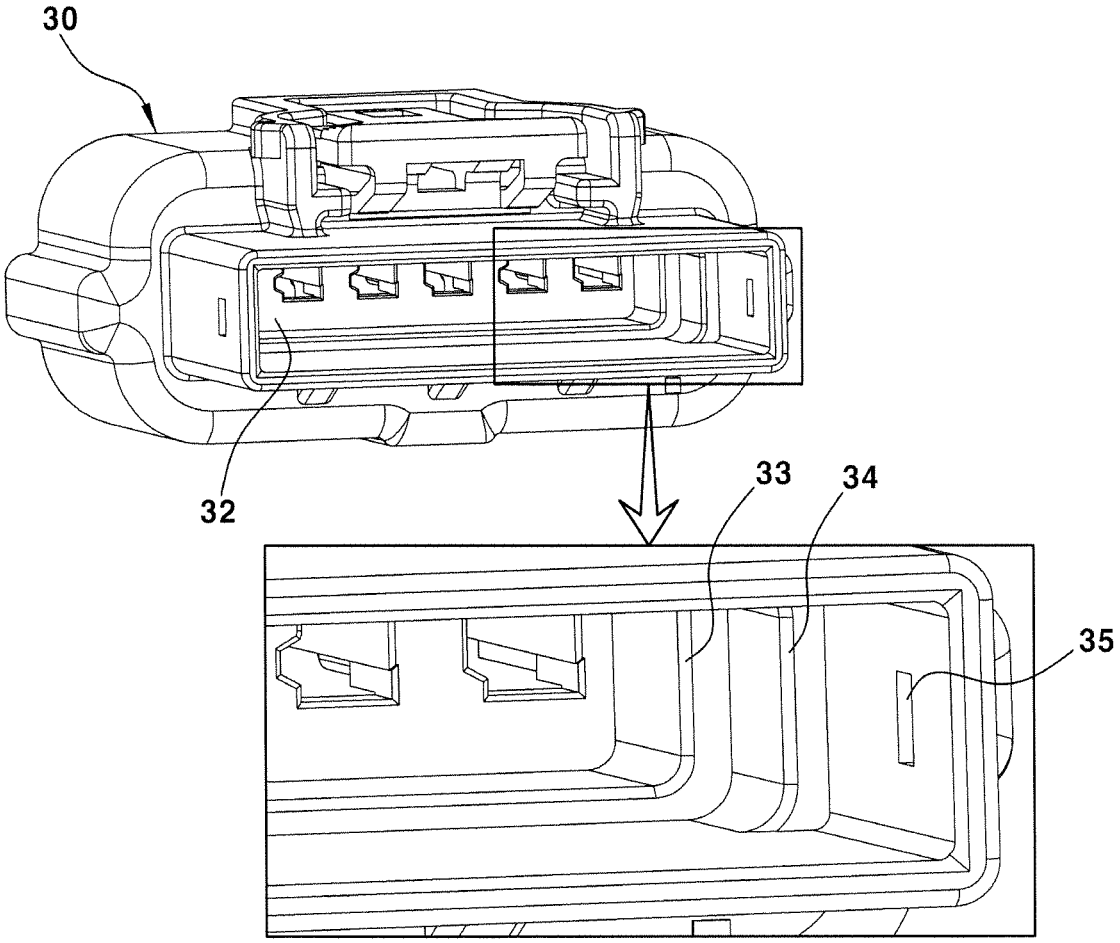
FIG. 3 is a perspective view illustrating a main housing of the waterproof connector for a vehicle according to an embodiment of the present disclosure.

As shown in FIG. 3, a first overlap-preventing stopper 33 protrudes from an inner side of the second mounting hole 32 to restrict a connecting position when the inner housing 50 enters. A second overlap-preventing stopper 34 protrudes from an outer side of the first overlap-preventing stopper 33. That is, the position of the second mounting hole 32 restricts the connecting position when inserting the subcover 70.

A subcover locking hole 35 is formed at an outermost side of the inner side of the second mounting hole 32 to lock and fix the subcover 70 when inserting the subcover 70.

Figure 2:
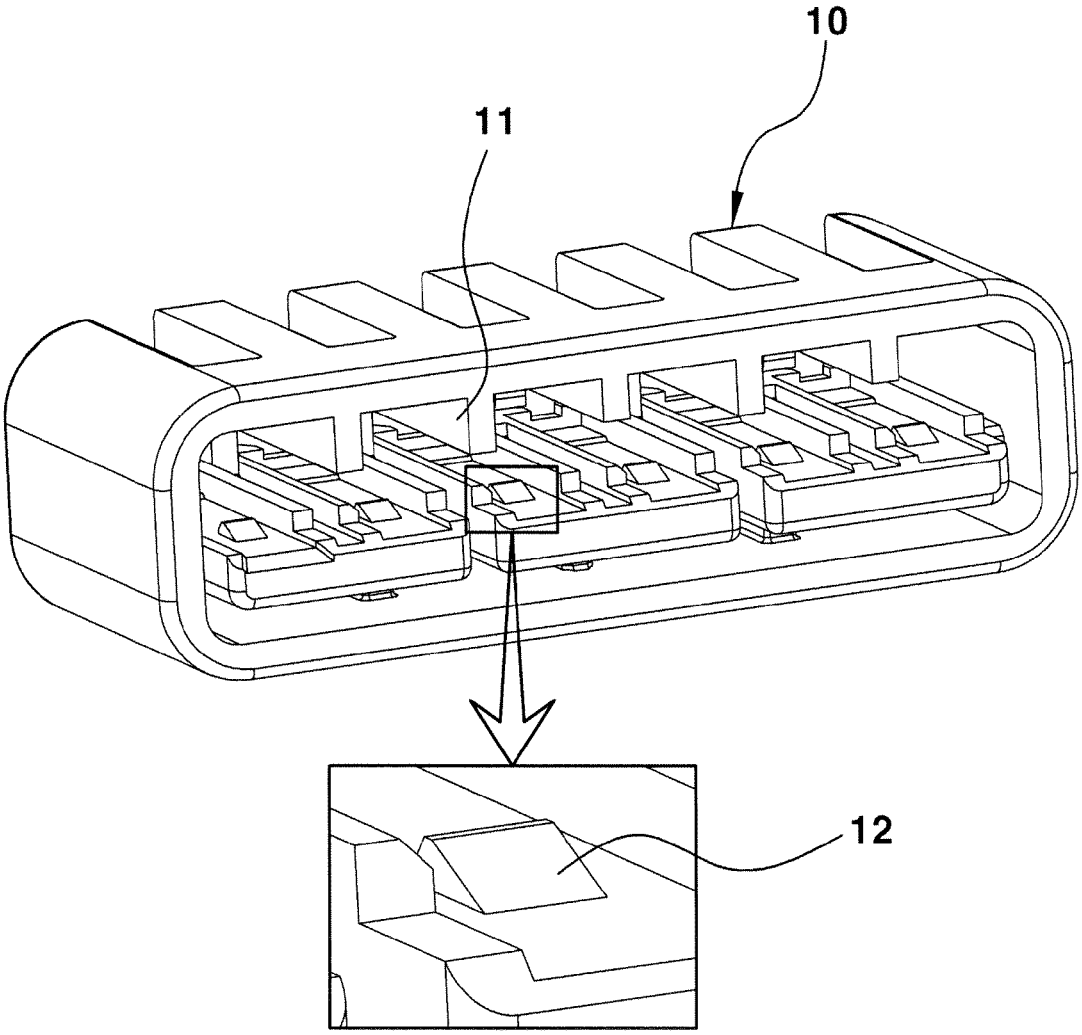
FIG. 2 is a perspective view illustrating a front holder of the waterproof connector for a vehicle according to an embodiment of the present disclosure.

Referring to FIG. 2, the front holder 10 supports and fixes the connector portions 41 of front sides of the terminals 40, and includes a plurality of terminal connecting holes 11 formed along a longitudinal direction. Terminal locking protrusions 12 integrally protrude from a bottom of the terminal connecting holes 11 to limit a longitudinal connecting gap of the connector portions 41 and to lock the connector portions 41.

The front seal 20, which has a watertight ring structure, is inserted into the first mounting hole 31 of the main housing 30 before inserting the front holder 10 and prevents water penetration from the outside toward the terminals 40 between the front holder 10 and the main housing 30.

Figure 9:
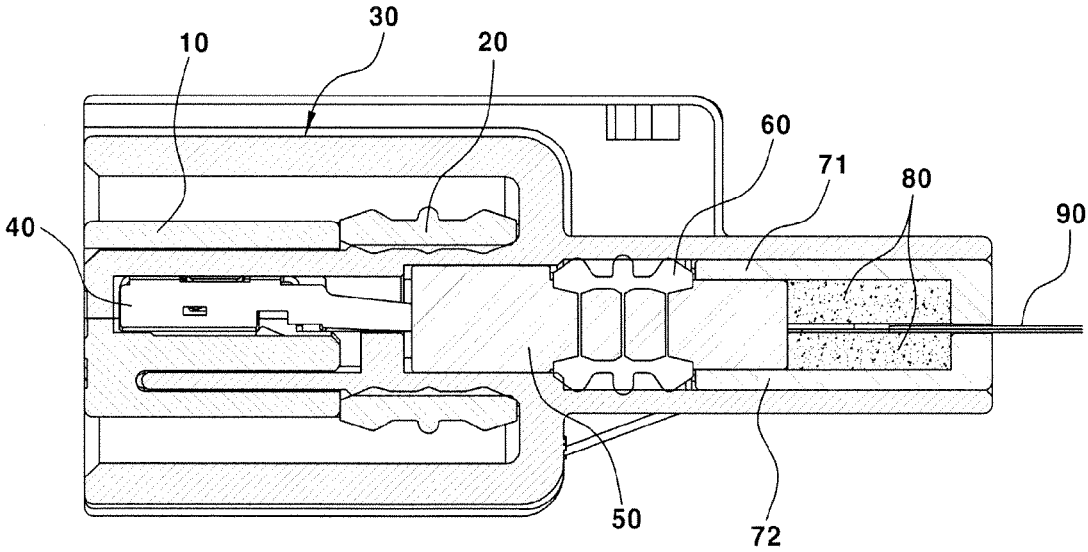
FIG. 9 is a sectional view the assembly of the waterproof connector for a vehicle according to an embodiment of the present disclosure taken along a line A-A of FIG. 8.

As illustrated in FIG. 9, the front seal 20 is inserted into and disposed inside the first mounting hole 31 of the main housing 30. Then, the front holder 10 is inserted into the first mounting hole 31, so that the front seal 20 exhibits the waterproof function for filling a gap between the front holder 10 and the main housing 30 for the watertight.

The inner housing 50 is inserted into the second mounting hole 32 of the main housing 30, in which a plurality of terminal insertion holes 51 penetrate the inner housing 50, and a front side of the inner housing 50 is thicker than a rear side.

Figure 5:
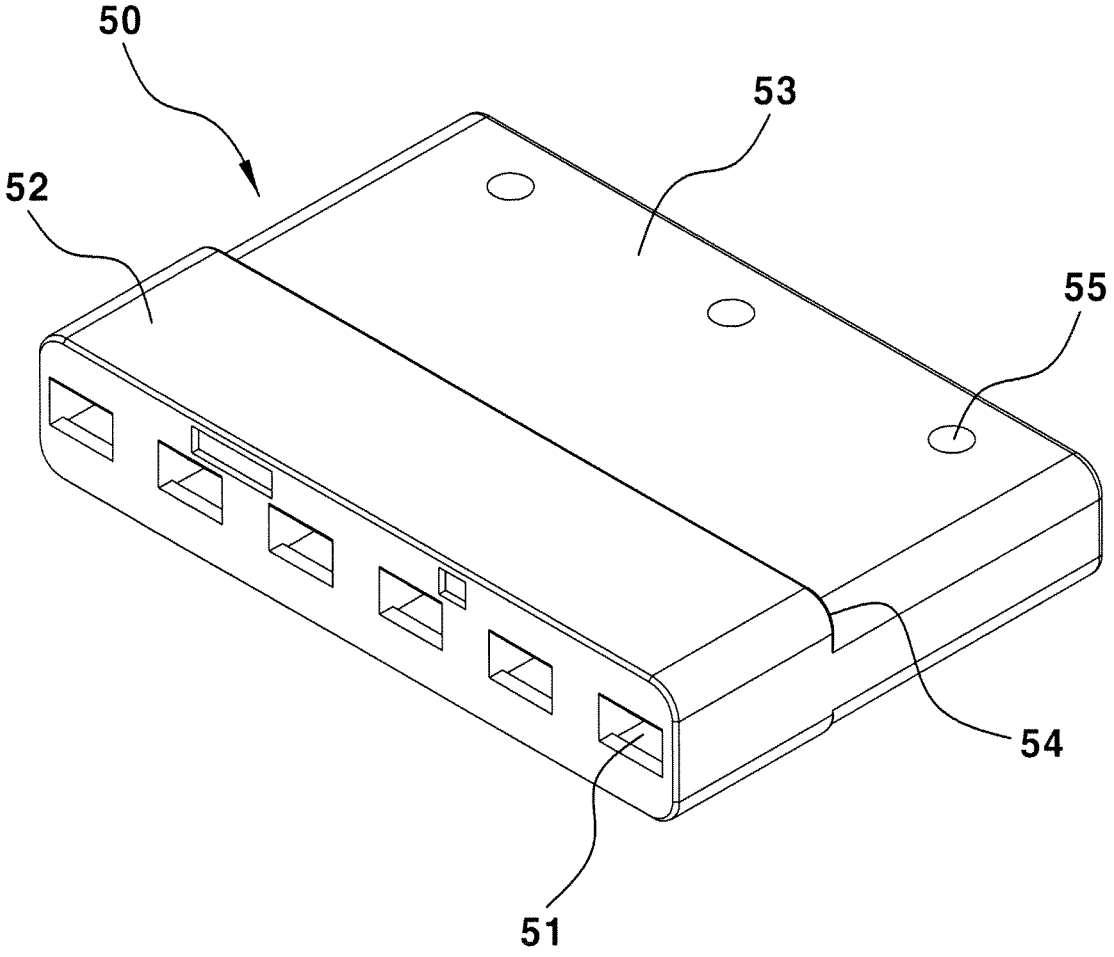
FIG. 5 is a perspective view illustrating an inner housing of the waterproof connector for a vehicle according to an embodiment of the present disclosure.

Referring to FIG. 5, the front thicker portion of the inner housing 50 serves as a press-fitting end 52 press-fitted into the second mounting hole 31, and the rear thinner portion of the inner housing 50 serves as a rear seal seat 53 which is thinner than the press-fitting end 52. A step between the press-fitting end 52 and the rear seal seat 53 holds the rear seal 60 not to lean forward when the rear seal 60 is inserted into the rear seal seat 53. The step serves as a third overlap-preventing stopper 54 for restricting the insertion position of the rear seal 60.

At the rear side of the rear seal seat 53 of the inner housing 50, a plurality of subcover connecting holes 55 penetrate vertically for the assembly with the subcover 70.

The rear seal 60, which has a watertight ring structure, is engaged with a peripheral of the inner housing 50 and is inserted into the second mounting hole 32 of the main housing 30 with the inner housing 50.

Referring to FIG. 9, when the rear seal 60 is engaged with the peripheral of the inner housing 50 and inserted into the second mounting hole 32 of the main housing 30 with the inner housing 50, the rear seal 60 fills a gap between the main housing 30 and the inner housing 50 to prevent water penetration.

Each of the terminals 40 includes a connector portion 41 inserted into the terminal connecting hole 11 of the front holder 10 and a wire welding portion 42 inserted into and penetrating the terminal insertion hole 51 of the inner housing 50, wherein the connector portion 41 and the wire welding portion 42 are integrally formed with each other.

Figure 4:
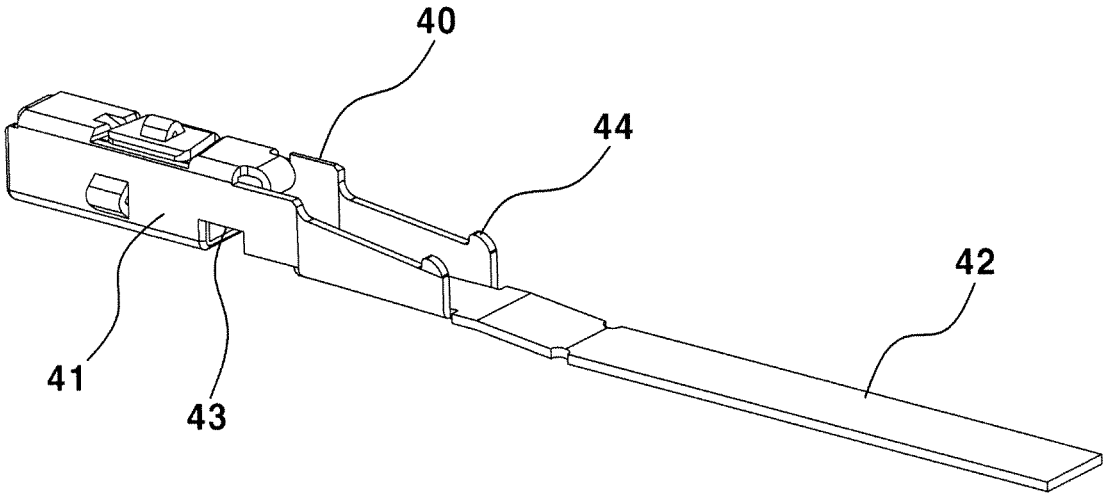
FIG. 4 is a perspective view illustrating a terminal of the waterproof connector for a vehicle according to an embodiment of the present disclosure.

As illustrated in FIG. 4, the connector portion 41 of the terminal 40 is to connect a male connector (not shown). The wire welding portion 42 is welded with a flexible flat cable 90 and has a flat shape for securing a welding area.

In this case, in a lower surface of the connector portion 41 of the terminal 40 is formed with a locking recess 43 with which a locking protrusion 12 of the front holder 10 is engaged.

When the connector portions 41 are coupled with the terminal connecting holes 11 of the front holder, the terminal locking protrusions 12 on the bottom of the terminal connecting holes 11 in locking recesses 43 of the connector portions 41 are inserted. Thus, longitudinal gaps of the connector portions 41 are restricted, and the connector portions 41 can be securely fixed.

In addition, on interfaces between the connector portions 41 and the wire-welding portions 42 of the terminals 40, fixing protrusions 44 press-fitted into the terminal insertion holes 51 of the inner housing 50 and integrally protrude, such that the terminals 40 do not move even with vibration of a vehicle and are maintain in a securely fixed state.

Figure 7:
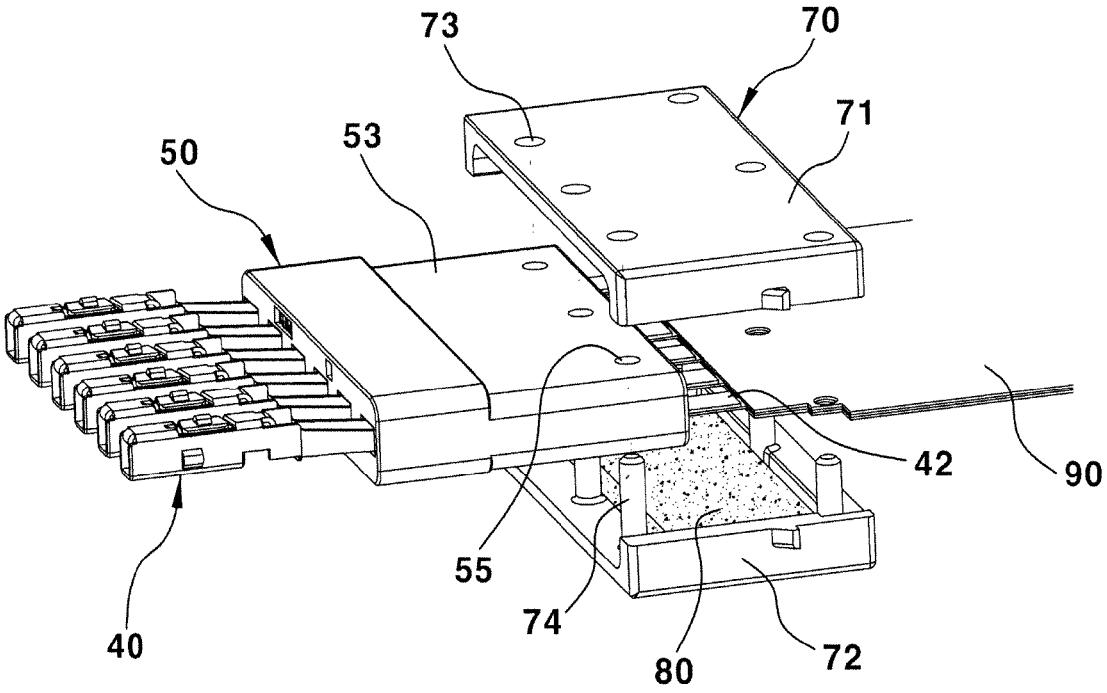
FIG. 7 is an exploded perspective view illustrating a connection between the inner housing and the subcover of the waterproof connector for a vehicle according to an embodiment of the present disclosure.

As illustrated in FIG. 7, the wire-welding portions 42 of the terminals 40 are arranged so as to pass through the terminal insertion holes 51 of the inner housing. Rear ends of the wire-welding portions 42 are exposed after passing through the terminal insertion holes 51 for the welding with the flexible flat cable 90.

Figure 6:
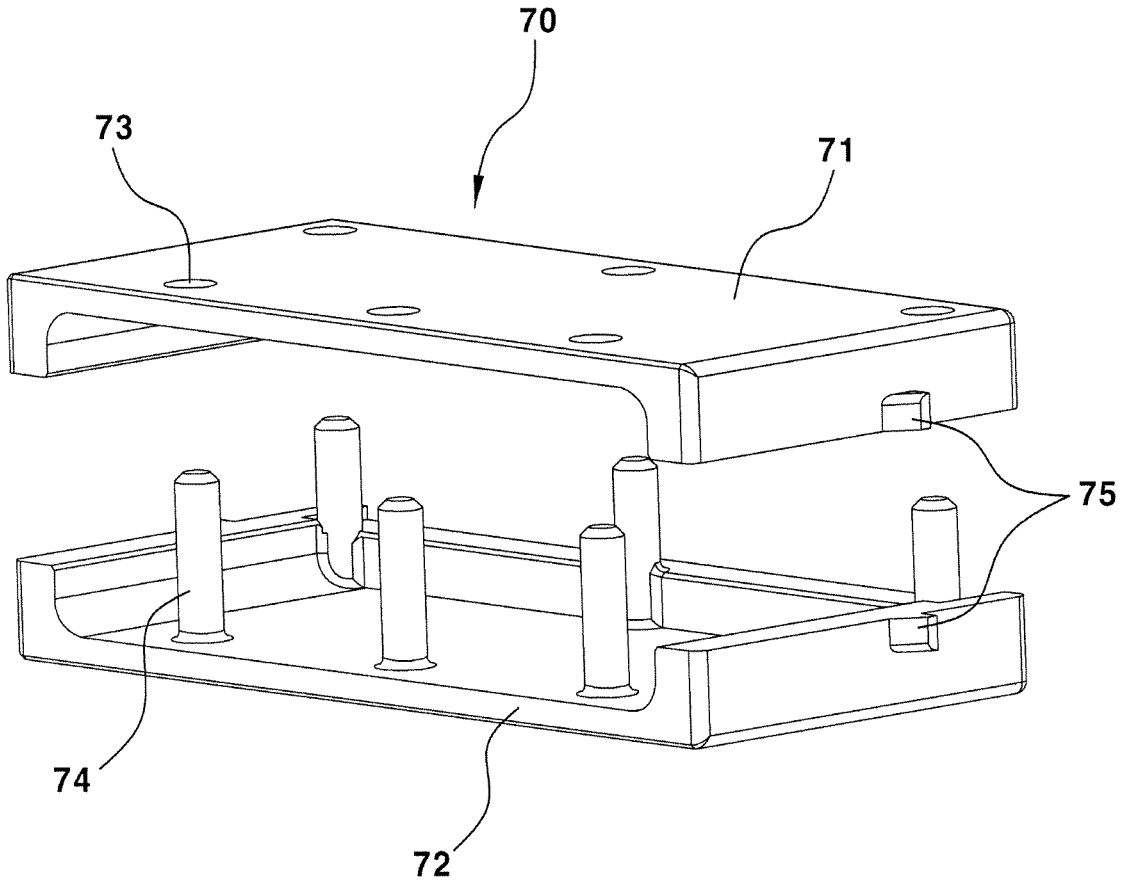
FIG. 6 shows a perspective view illustrating a subcover of the waterproof connector for a vehicle according to an embodiment of the present disclosure.

The subcover 70, as illustrated in FIG. 6, includes an upper cover 71 and a lower cover 72, which are assembled with the upper side and the lower side of the rear seal seat 53 of the inner housing 50 respectively to cover the wire-welding portions 42 of the terminals 40.

In more detail, the upper cover 71 of the subcover 70 has subcover mounting holes 73 aligned with the subcover connecting holes 55 of the rear seal seat 53 of the inner housing 50, and penetrating the upper cover 71 vertically. The lower cover 72 has subcover assembling pins 74 sequentially inserted into the subcover connecting holes 55 and the subcover mounting holes 73.

The subcover assembling pins 74 of the lower cover 72 are inserted into the subcover connecting holes 55 of the rear seal seat 53 and subcover mounting holes 73 of the upper cover 71 sequentially. Thus, the subcover 70 is integrally assembled with the inner housing 50 and protects the rear ends of the wire-welding portions 42 of the terminals 40, that is, the connecting portions with the flexible flat cable 90, from an exterior force or water.

In this case, the subcover 70, that is the assembled upper cover 71 and lower cover 72, has subcover locking protrusions 75 formed on the sides thereof.

The inner housing 50, with which the subcover 70 is assembled, is inserted into the second mounting hole 32 of the main housing 30. The subcover locking protrusions 75 are inserted into the subcover-locking holes on an inner wall of the second mounting hole 32, so that the subcover 70 can be securely fixed to the main housing 30.

Before assembling the subcover 70 to the inner housing 50, butyl rubber-made watertight and vibration-absorbing members 80 are attached to the lower side the upper cover 71 and the upper side of the lower cover 72, respectively.

As such, the watertight and vibration-absorbing materials 80 are attached to the upper cover 71 and the lower cover 72, so that the wire-welding portions 42 of the terminals 40, that is, the connecting portions with the flexible flat cable 90 is pressed by the watertight and vibration-absorbing materials 80 for sealing.

Thus, the watertight and vibration-absorbing materials 80 may improve the waterproof performance of the wire-welding portions 42 and vibration resistance performance for absorbing vibration and preventing the wire-welding portions 42 from being short.

Although the present disclosure has been described in detail until now, the scope of the present invention is not limited to the description, but various modifications made by those skilled in the art using the basic concept of the present disclosure defined by the claims also fall within the scope of the present disclosure.

What is claimed is:

1. A waterproof connector for a vehicle, comprising:

a main housing having a first mounting hole, formed on a front side thereof, in which a front holder is disposed and a second mounting hole, formed on a rear side thereof, in which an inner housing and a subcover are disposed;

a watertight front seal disposed inside the first mounting hole before the front holder;

a watertight rear seal engaged with a peripheral of an inner side and disposed inside the second mounting hole of the main housing with the inner housing;

a plurality of terminals, each of which has a connector portion which is disposed inside a terminal-connecting hole of the front holder and a wire-welding portion which is disposed inside a terminal insertion hole of the inner housing, in which the connector portion and the wire-welding portion are integrally formed with each other; and watertight and vibration-absorbing materials attached to a lower side of an upper cover and an upper side of a lower cover of the subcover protecting a plurality of wire-welding portions of the plurality terminals, wherein the front holder is disposed inside the first mounting hole of the main housing, closely attached to the front seal, and has the plurality of terminal connecting holes corresponding to the plurality of terminals, the inner housing, which is disposed inside the second mounting hole of the main housing, has the plurality of terminal insertion holes corresponding to the plurality of terminals, a front press-fitting end inside the second mounting hole, and a rear seal seat, a thickness of which is thinner than that of the front press-fitting end, and the subcover is disposed inside the second mounting hole of the main housing and includes the upper cover and the lower cover which are assembled with upper and lower sides of the rear seal seat of the inner housing to cover the wire-welding portions of the terminals.

2. The waterproof connector of claim 1, wherein the main housing includes a first overlap-preventing stopper and a second overlap-preventing stopper which protrude from an inner surface of the second mounting hole of the main housing to prevent the inner housing and the subcover from overlapping, wherein the first and second overlap-preventing stoppers are spaced apart in a longitudinal direction.

3. The waterproof connector of claim 1, wherein the main housing has a subcover-locking hole formed on an inner wall of the second mounting hole of the main housing.

4. The waterproof connector of claim 1, wherein the front holder has terminal locking protrusions integrally protruding from a bottom of each terminal-connecting hole.

5. The waterproof connector of claim 1, wherein a step between the front press-fitting end of the inner housing and the rear seal seat serves as a third overlap-preventing stopper for preventing the rear seal.

6. The waterproof connector of claim 1, wherein the rear seal seat has a plurality of subcover-connecting holes formed at a rear side of the inner housing to penetrate the rear seal seat vertically.

7. The waterproof connector of claim 1, wherein the connector portion has locking recesses, formed on a lower side of each of the plurality of terminals, with which terminal locking protrusions of the front holder are engaged.

8. The waterproof connector of claim 1, wherein fixing protrusions are press-fitted into the terminal insertion holes of the inner housing and protrude integrally on interfaces between the connector portions of the plurality of terminals and the wire-welding portions.

9. The waterproof connector of claim 1, wherein the upper cover of the subcover has subcover-mounting holes aligned with subcover-connecting holes of the rear seal seat and penetrating the upper cover, and the lower cover has subcover assembling pins integrally formed on the upper side of the lower cover and sequentially disposed inside the subcover-connecting holes and the subcover-mounting holes.

10. The waterproof connector of claim 1, wherein the upper cover and the lower cover of the subcover have subcover locking protrusions formed on sides thereof and disposed inside subcover-locking holes formed in an inner wall of the second mounting hole.

11. The waterproof connector of claim 1, wherein the watertight and vibration-absorbing materials are made of butyl rubber.

* * * * *